United States Patent [19]

Sutoh et al.

[11] Patent Number: 4,803,317

[45] Date of Patent: Feb. 7, 1989

[54] SUPPORT STRUCTURE FOR ROCKABLE CONDUCTIVE PLATE IN A SEESAW-TYPE SWITCH

[75] Inventors: Hiroki Sutoh, Miyagi; Kenji Sawada, Furukawa, both of Japan

[73] Assignee: Alps Electric Co., Ltd., Japan

[21] Appl. No.: 109,276

[22] Filed: Oct. 15, 1987

[30] Foreign Application Priority Data

Jan. 19, 1987 [JP] Japan ..... 62-4987[U]

[51] Int. Cl.[4] ..... H01H 23/24

[52] U.S. Cl. ..... 200/438; 200/6 BA; 200/339

[58] Field of Search ..... 200/68.2, 68.3, 68.1, 200/339, 6 BB, 6 BA

[56] References Cited

U.S. PATENT DOCUMENTS

| | | | |
|---|---|---|---|
| 3,746,359 | 7/1973 | Lewis | 200/68.2 |
| 4,022,999 | 5/1977 | Brown | 200/68.2 |
| 4,571,467 | 2/1986 | Sorenson et al. | 200/68.2 |
| 4,654,487 | 3/1987 | Sawada | 200/1 V |

FOREIGN PATENT DOCUMENTS

| | | | |
|---|---|---|---|
| 1948971 | 4/1971 | Fed. Rep. of Germany | 200/339 |

*Primary Examiner*—Renee S. Luebke

*Attorney, Agent, or Firm*—Guy W. Shoup; Paul J. Winters; Leighton L. Chong

[57] ABSTRACT

A switch device having a casing, a central terminal and stationary contacts arranged on the bottom wall of the casing, at least one conductor plate swinging at the central terminal as a center for contacting or separating the central terminal with or from the stationary contact, at least one movable contact formed at the conductor plate for contacting with or separating from the stationary contact, and a driver for swinging the conductor plate by tilting at the tilting fulcrum as a center which comprises an edge formed at the upper end of the central terminal, guide grooves extending elevationally at both side walls of the casing oppositely through the central terminal and formed, projections formed at both side edges of the conductor plate to be inserted into the guide grooves, the lower surface of the conductor plate being placed on the edge of the central terminal. Thus, the switch device can be simply assembled with the conductor plates.

2 Claims, 12 Drawing Sheets

SUPPORT STRUCTURE FOR ROCKABLE CONDUCTIVE PLATE IN A SEESAW-TYPE SWITCH

BACKGROUND OF THE INVENTION

1. Field of the Invention

This invention relates to a switch device used as a switch for a power source of electric or electronic equipment.

2. Description of the Prior Art

Various types of switch devices are used according to utilities, and a conventional switch device used for driving an electric motor of an automotive antenna elevator or a power window system of seesaw type as shown in FIGS. 12 to 16 has been heretofore known.

In FIGS. 12 to 16, reference numeral 1 designates a synthetic resin case opened at its top, numeral 2 denotes a switch actuator supported by a pin 3 to the top of the case 1, numeral 4 depicts a presser fixedly engaged with the top of the switch actuator 2, which is swingably moved with the pin 3 as a fulcrum by tilting the presser 4 from a neutral position shown in FIG. 12 in either direction of arrow X or Y in FIG. 12. In FIG. 15, a pair of compression springs 5, 6 are contained in the switch actuator 2, first and second drivers 7, 8 energized by the compression springs 5, 6, respectively are inserted into the actuator 2, and the lower ends of the drivers 7, 8 are elastically contacted with the upper surfaces of first and second conductor plates 9, 10, respectively.

The first conductor plate 9 is in a V shape. Cutouts **9*a* to become swinging fulcra are formed at both lateral sides of the first conductor plate 9, and movable contacts 11, 12 are attached to both the longitudinal ends of the first conductor plate 9. Similarly, the second conductor plate 10 is bent in a V shape. Cutouts 10*a* to become swinging fulcra are formed at both lateral sides of the second conductor plate 10 to the first conductor plate 9, and movable contacts 13, 14 are attached to both the longitudinal ends of the second conductor plate 10**.

Four stationary contacts 15, 16, 17, 18 are shown in FIG. 13 and 16 to be arranged corresponding to the movable contacts 11, 12, 13, 14 on the inner bottom of the case 1, and central terminals 19, 20 are arranged between the stationary contacts 15 and 16 and between the stationary contacts 17 and 18. The central terminals 19, 20 are formed of L-shaped bent metal plates, and a pair of engaging projections **19*a*, 20*a* are bent in L shape at both sides of the upper ends of the central terminals 19, 20, respectively. The engaging projections 19*a*, 20*a* are so inserted into the cutouts 9*a*, 10*a* as to hold the first and second conductor plates 9, 10, which are thus swung with the central terminals 19, 20** as fulcra.

A pair of partition walls **1*a*, 1*b* (FIG. 15) are so extended as to partition the first and second conductor plates 9, 10 at both lateral sides of the case 1. A part of a lead plate 21 (FIG. 13) bent in a hook shape, is inserted between the partition walls 1*a* and 1*b* so that the ends of the lead plate 21 are connected respectively to the stationary terminals 15 and 18. Terminals 22, 23, 24, 25 in FIG. 14, connected to the stationary contacts 15, 16, 17, 18, are attached to the bottom of the case 1, terminals 26, 27 corresponding to the central terminals 19, 20 are attached by rivets 28, and the terminals 23, 24 are connected through leads 29. The terminals 22 to 27 are connected to the terminals of an electric motor driving circuit in FIG. 17 to normally or reversely rotate the electric motor M. Reference numeral 30 designates a rubber cover to be fixed on the top of the case 1 to prevent moisture or dusts from being introduced into the case 1**.

When a pressing force to the presser 4 is released in the switch device constructed as described above, the first and second drivers 7, 8 are elastically contacted with the valleys of the V-shaped bent portions of the first and second conductor plates 9, 10, and the switch actuator 2 is disposed at the neutral position shown in FIG. 12. The movable contacts 12, 13 are contacted under pressure with the stationary contacts 16, 17, the movable contacts 11, 14 are separated from the stationary contacts 15, 18, and both the conductor plates 9, 10 are disposed at the positions designated by solid lines in FIG. 17 at this neutral position. Therefore, a power source E is not connected to the motor M, which is not rotated.

When the presser 4 is pressed from the neutral position in a direction of the arrow X in FIG. 12, the first and second drivers 7, 8 are slid on the oblique surfaces of the first and second conductor plates 9, 10, and the first conductor plate 9 is swung to the stationary contact 15 side with the engaging projection 19a of the central terminal 19 as a fulcrum as shown in FIG. 16. In this case, the second conductor plate 10 remains pressed at the movable contact 13 by the stationary contact 17 conductor plate 10 is not swung, only the first conductor plate 9 is switched to the state shown by broken lines in FIG. 17, and the motor M is, for example, rotated in a normal direction.

Similarly, when the presser 4 is pressed from the neutral position in a direction of the arrow Y in FIG. 12, the first conductor plate 9 is not swung, but only the second conductor plate 10 is swung to the stationary contact 18 side to be switched to the state shown by broken line in FIG. 17, and the motor M is rotated reversely.

In the switch device of the type described above, the cutouts **9*a*, 10*a* formed at both lateral sides of the first and second conductor plates 9, 10 are inserted into the L-shaped engaging projections 19*a*, 20*a* bent at the upper ends of the central terminals 19, 20. Thus, clearances between the cutouts 9*a*, 10*a* and the engaging projections 19*a*, 20*a* are reduced, and the conductor plates 9, 10 are smoothly swung. However, since the conductor plates 9, 10 must be inserted from oblique direction, i.e., from the extending direction of the engaging projections 19*a*, 20*a* to engage the cutouts 9*a*, 10*a* with the engaging projections 19*a*, 20*a***, there arises a drawback that an automation of assembling work is difficult.

SUMMARY OF THE INVENTION

Accordingly, an object of this invention is to provide a switch device which can eliminate the above-described drawbacks of the prior art and which has simply assembled conductor plates.

In order to achieve the above and other objects of the invention, an edge is formed at the top of a central terminal, guide grooves are formed in both side walls of a casing with axes coincident with the edge on the central terminal, projections formed at both sides of the conductor plate are inserted into the guide grooves, and the lower surface of the conductor plate is placed on the edge of the central terminal as a swinging fulcrum.

According to the switch device constructed as described above, the conductor plate can be smoothly swung with the edge of the central terminal which acts as a fulcrum in the state that the projections are restricted in the guide grooves of the casing. Further, the conductor plate may simply be dropped into the guide grooves in the casing, thereby allowing assembly by an automatic machine.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Embodiments of a switch device according to the present invention will be described in detail with reference to the accompanying drawings.

Figure 1:
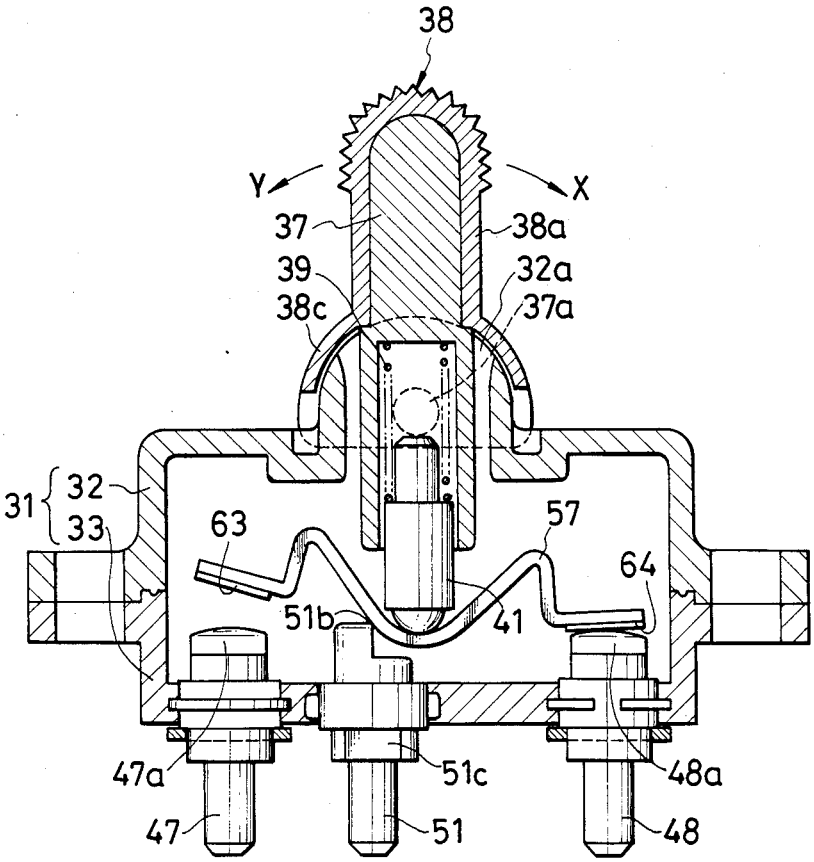
FIG. 1 is a front sectional view showing an embodiment of a switch device according to the present invention.
Figure 2:
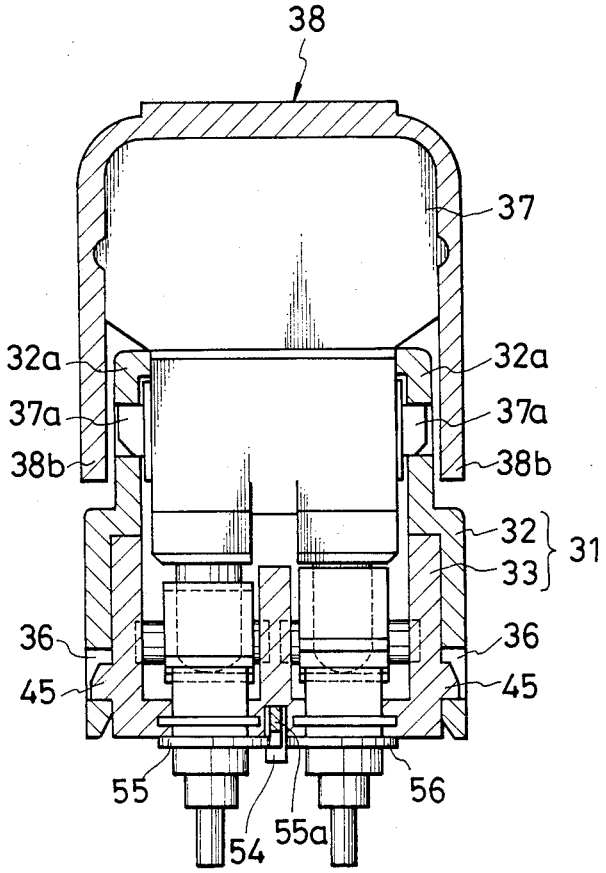
FIG. 2 is a side sectional view of the embodiment of FIG. 1.
Figure 3:
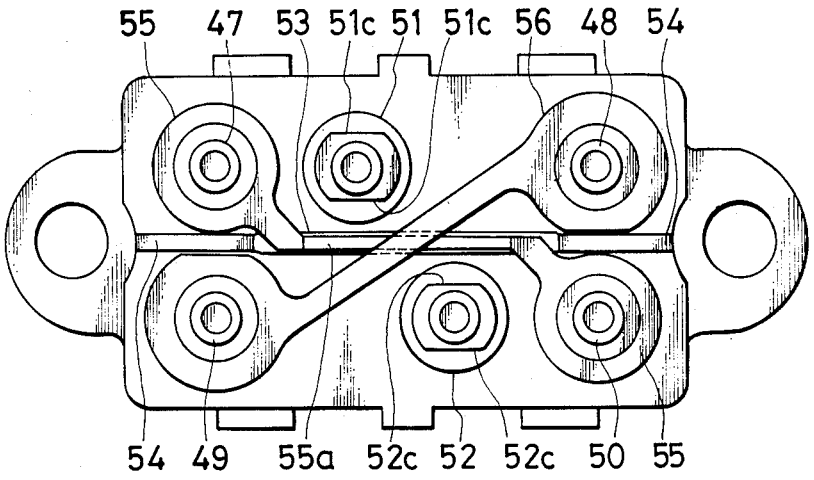
FIG. 3 is a bottom view of the embodiment.
Figure 4:
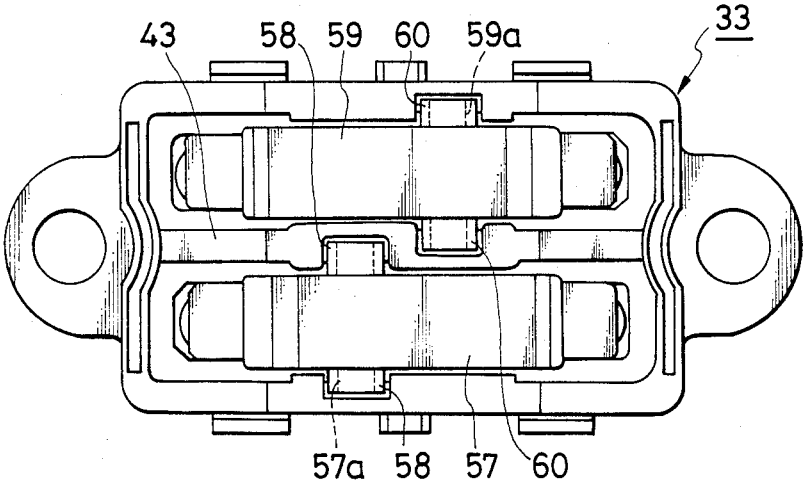
FIG. 4 is a plan view of the switch device from which an upper cas is removed.
Figure 5:
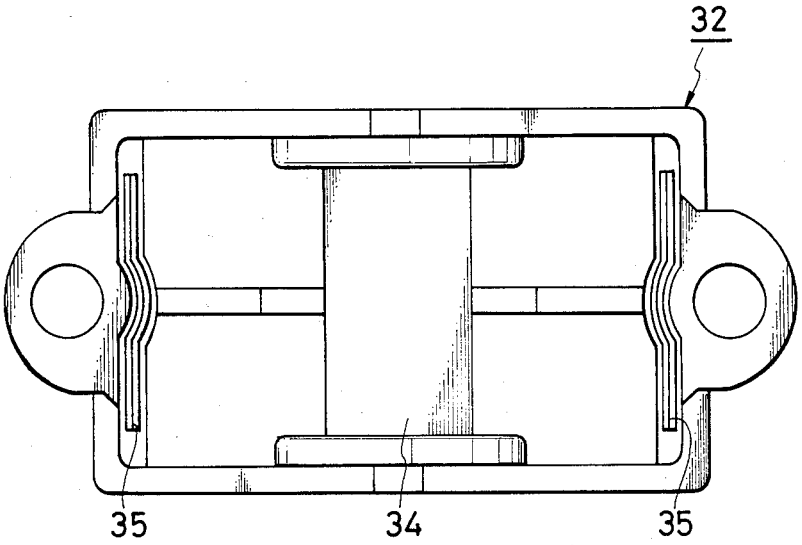
FIG. 5 is a bottom view of the upper case.
Figure 6:
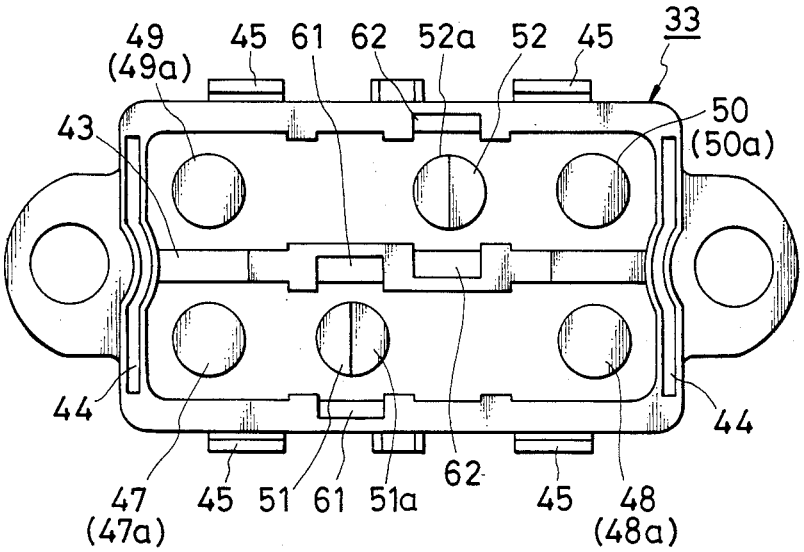
FIG. 6 is a plan view of a lower case.
Figure 7:
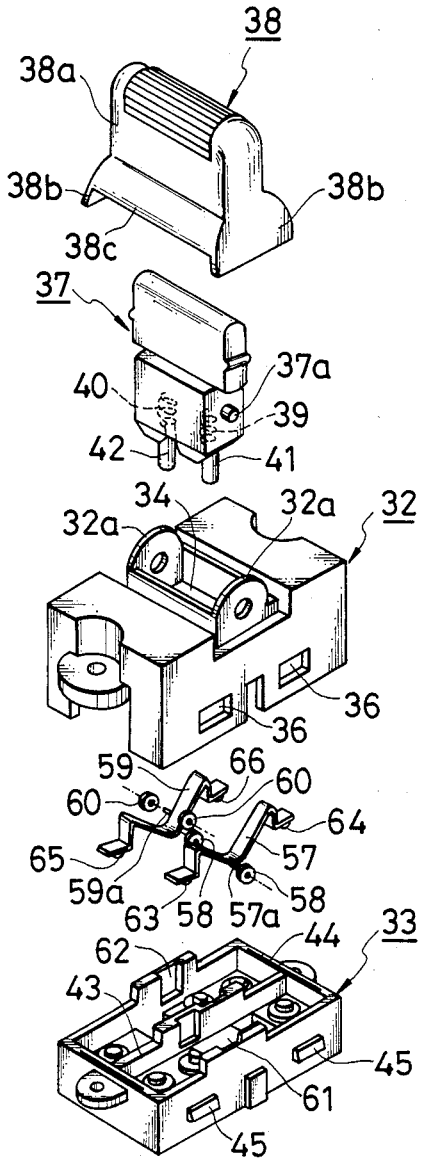
FIG. 7 is an exploded perspective view of the entire switch device.
Figure 8:
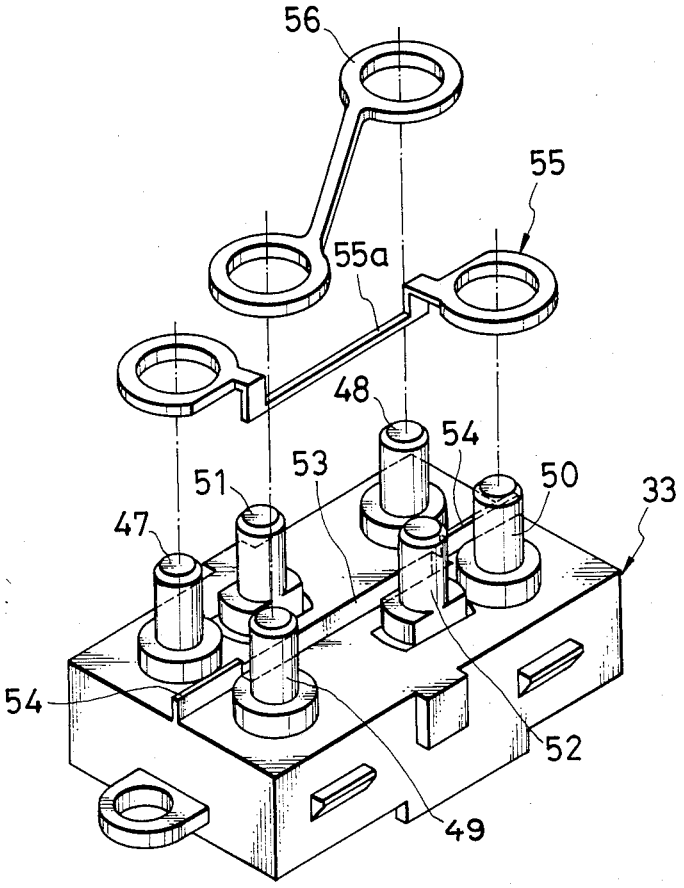
FIG. 8 is a perspective view showing the relationship between the lower case and a lead plate.
Figure 9:
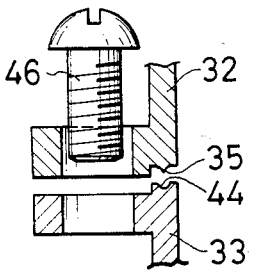
FIG. 9 is a sectional view of an essential portion showing a connecting portion of the upper case and the lower case.
Figure 10:
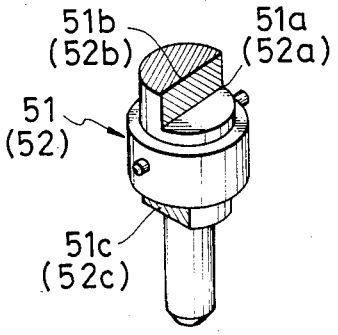
FIG. 10 is a perspective view of a central terminal.
Figure 11:
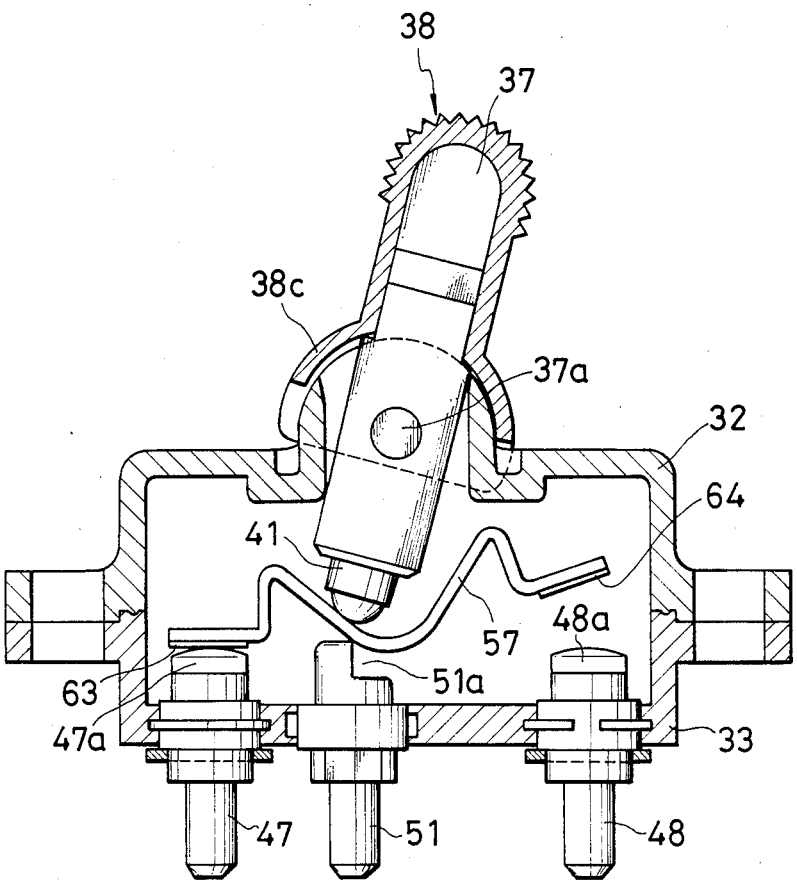
FIG. 11 is a front sectional view showing the operating state of the switch device.
Figure 12:
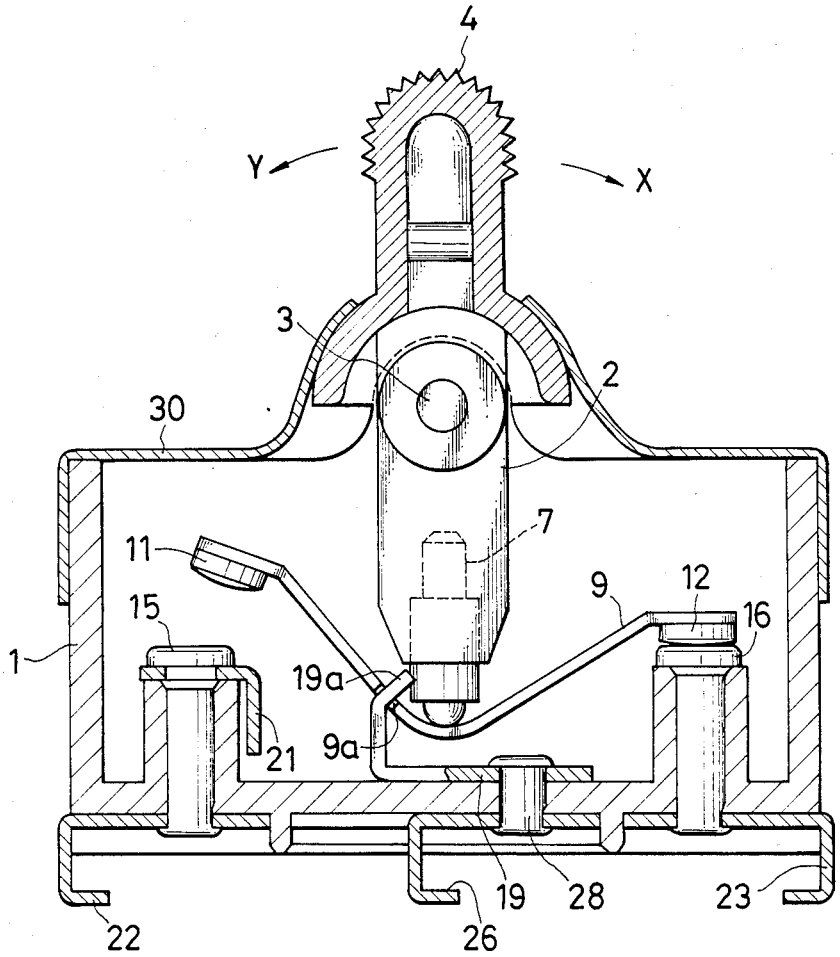
PRIOR ART FIG.12
FIG. 12 is a front sectional view of a conventional switch device.
Figure 13:
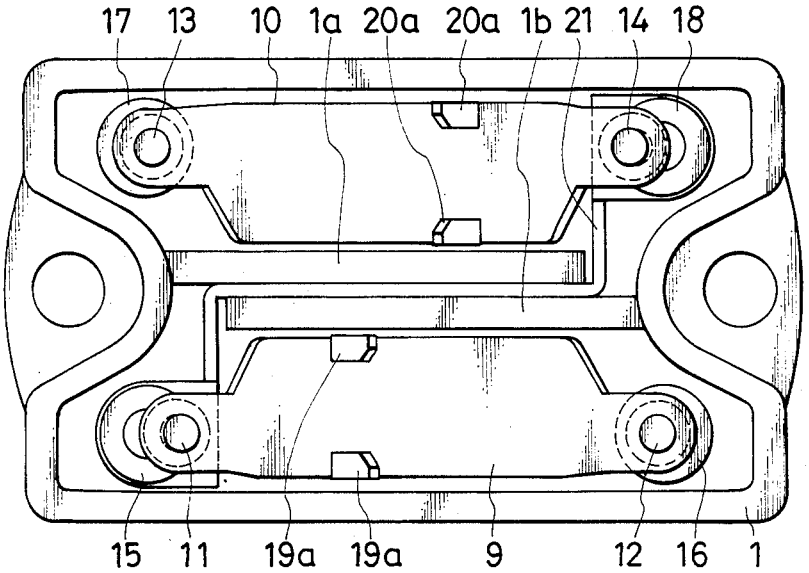
PRIOR ART FIG. 13
FIG. 13 is a plan view of the conventional switch device partly omitted.
Figure 14:
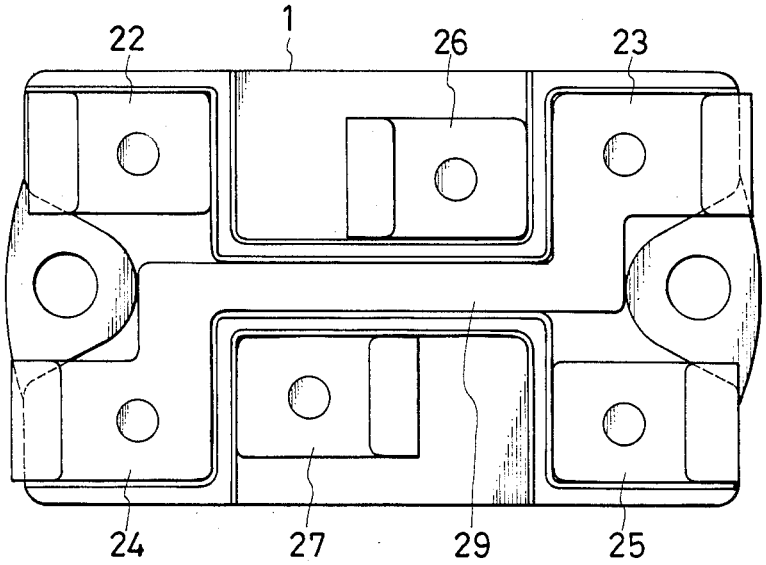
PRIOR ART FIG. 14
FIG. 14 is a bottom view of the conventional switch device.
Figure 15:
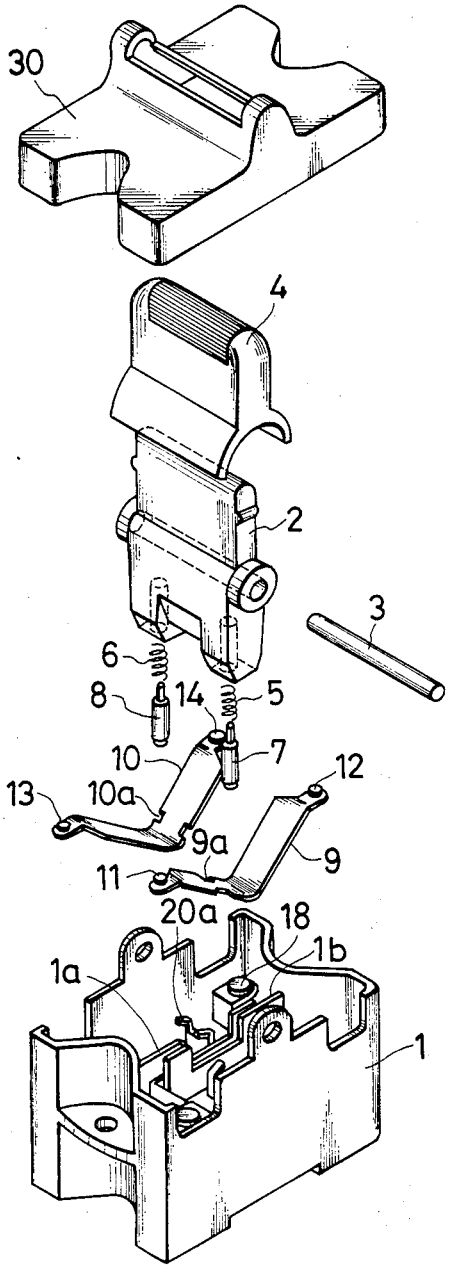
PRIOR ART FIG.15
FIG. 15 is an exploded perspective view of the entire switch device.
Figure 16:
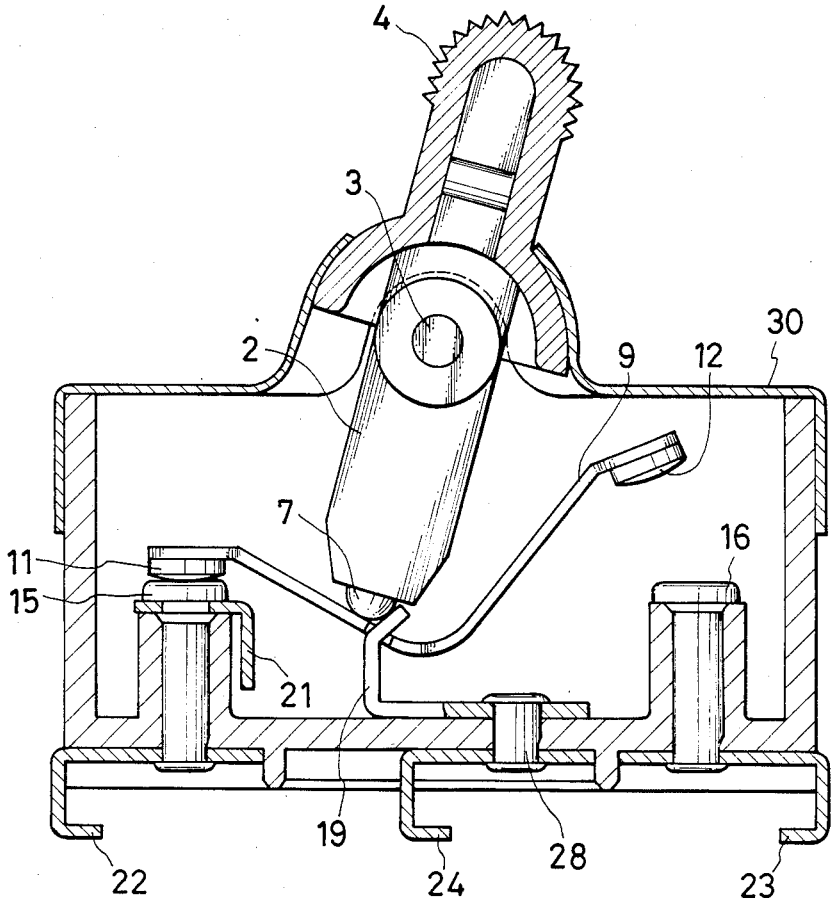
PRIOR ART FIG. 16
FIG. 16 is a front sectional view showing the operating state of the conventional switch device.

FIG. 1 is a front sectional view showing an embodiment of a switch device according to the present invention, FIG. 2 is a side sectional view of the embodiment of FIG. 1, FIG. 3 is a bottom view of the embodiment, FIG. 4 is a plan view of the switch device from which an upper case is removed, FIG. 5 is a bottom view of the upper case, FIG. 6 is a plan view of a lower case, FIG. 7 is an exploded perspective view of the entire switch device, FIG. 8 is a perspective view showing the relationship between the lower case and a lead plate, FIG. 9 is a sectional view of an essential portion showing a connecting portion of the upper case and the lower case, FIG. 10 is a perspective view of a central terminal, and FIG. 11 is a front sectional view showing the operating state of the switch device.

In FIG. 1, reference numeral 31 designates a casing for forming an outer shell of the switch device, which casing has an upper case 32 and a lower case 33. A pair of ears 32*a* (FIGS. 1 and 7) are formed at the top of the upper case 32, and an opening 34 is formed between the ears 32*a*. As shown in FIG. 5, V-shaped sectional projections 35 are formed in the bottom of both side walls of the upper case 32.

In FIG. 7, pins 37*a* integrally formed with a switch actuator 37 are supported to both ears 32*a* of the upper case 32, and the top of the switch actuator 37 is projected upward from the opening 34. A push cover 38 is engaged fixedly with the top of the switch actuator 37, and first and second drivers 41, 42 are respectively inserted through a pair of compression springs 39, 40 to the lower portion of the switch actuator 37. The cover 38 has a knob 38*a* covered on the top of the switch actuator 37, semicircular walls 38*b* disposed outside both the ears 32*a* of the upper case 32, and a semicylindrical skirt 38*c* for bridging between the walls 38*b*, and the opening 34 of the upper case 32 is always covered by the walls 38*b* and the skirt 38*c* irrespective of the attitude of the switch actuator 37.

As shown in FIG. 6, the lower case 33 is partitioned by a partition wall 43 longitudinally into two chambers, and semicircular sectional grooves 44 are formed on the upper surfaces of both side walls of the lower case 33 corresponding to the projections 35 of the upper case 32. Further, upwardly converged snap projections 45 are formed on the lower case 33 corresponding to the engaging window openings 36 of the upper case 32, (FIG. 7) and the upper case 32 and the lower case 33 are integrated by snap-fitting the engaging window openings 36 to the snap projections 45. In this case, since the projections 35 and the grooves 44 are formed as described above on the connecting surfaces of the upper case 32 and the lower case 33, the hermetical seal between the upper case 32 and the lower case 33 is improved as compared with simple plane contact. When both the cases 32 and 33 are clamped with screws 46 as shown in FIG. 9, the end of he projection 35 is collapsed in the shape of the groove 44. Thus, the hermetical seal on the connecting surfaces of both the cases 32, 33 is further improved. The lower case 33 covered by the peripheral wall of the upper case 32 performs dustproof and waterproof functions together with the cover 38 as described above in the switch device.

Four stationary terminals 47, 48, 49, 50 and two central terminals 51, 52 are integrally injection molded with the lower case 33, and are arranged as shown in FIG. 6. The stationary terminals 47 to 50 are formed, for example, of copper alloy, and stationary contacts 47*a*, 48*a*, 49*a*, 50*a* are attached to the upper surfaces of the terminals 47 to 50. The central terminals 51, 52 are formed of silver-plated copper alloy. The central terminals 51, 52 have cutouts 51*a*, 52*a* of D-shaped plane configuration at the upper ends as shown in the external appearance in FIG. 10, and the linear portions 51*a*, 52*b* of the upper ends formed of the cutouts 51*a*, 52*a* become fulcrums of the conductor plates to be described later. Further, flat surfaces 51*c*, 52*c* are cut perpendicularly to the linear portions 51*b*, 52*b* at the central portions of the central terminals 51, 52, and the hatched portion in FIG. 10 including the flat surfaces 51*c*, 52*c* is disposed in an injection mold (not shown) to be molded. When the central terminals 51, 52 restricted in the rotating direction are molded in this manner, the linear portions 51*b*, 52*b* can be accurately positioned at a predetermined position to stably support the conductor plate.

As apparent from FIGS. 3 and 8, a groove 53 formed longitudinally and projecting walls 54 disposed at both ends of the groove 53 are continuously formed at the center on the lower surface of the lower case 33. A stepped bent portion 55*c* of the first lead plate 55 made of a metal plate is inserted into the groove 53, and both ends of the first lead plate 55 are press-fitted to the stationary terminals 47, 50. The second lead plate 56 is formed planely, and is press-fitted at its both ends to the stationary terminals 48,49 obliquely across the groove 53. Therefore, the lead plates 55, 56 are reliably insulated at the ends by the projecting walls 54, and are maintained reliably in noncontacting state by the groove 53 at the central crossing portion.

FIG. 7 shows the first conductor plate 57 is bent to form an M shape, movable contacts 63, 64 are attached to longitudinal ends of the first conductor plate 57, projections 57*a* are formed laterally at both sides of one oblique surface, and synthetic resin rings 58 are press-fitted or attached by molding to the projections 57*a*. Similarly, the second conductor plate 59 is bent to form an M shape, movable contacts 65, 66 are attached to the longitudinal ends of the second conductor plate 59, projections 59*a* are formed laterally at both sides of the oblique surface oppositely to the first conductor plate 57, and synthetic resin rings 60 are attached to the projections 59*a*.

As shown in FIGS. 4 and 6, guide grooves 61, 62 formed in the walls and partition 43 of the lower case 33. These grooves 61, 62 are aligned to have axes that coincide with the edges 51*b*, 52*b* of the central terminals 51, 52, and the first and second conductor plates 57, 59 are placed on the linear portions 51*b*, 52*b* of the central terminals 51, 52 such that the rings 58, 60 are inserted into the guide grooves 61, 62. Therefore, the first and second conductor plates 57, 59 are guided by the guide grooves 61, 62 to pivot on the edge-shaped linear portions 51*b*, 52*b* of the central terminals 51, 52.

Figure 17:
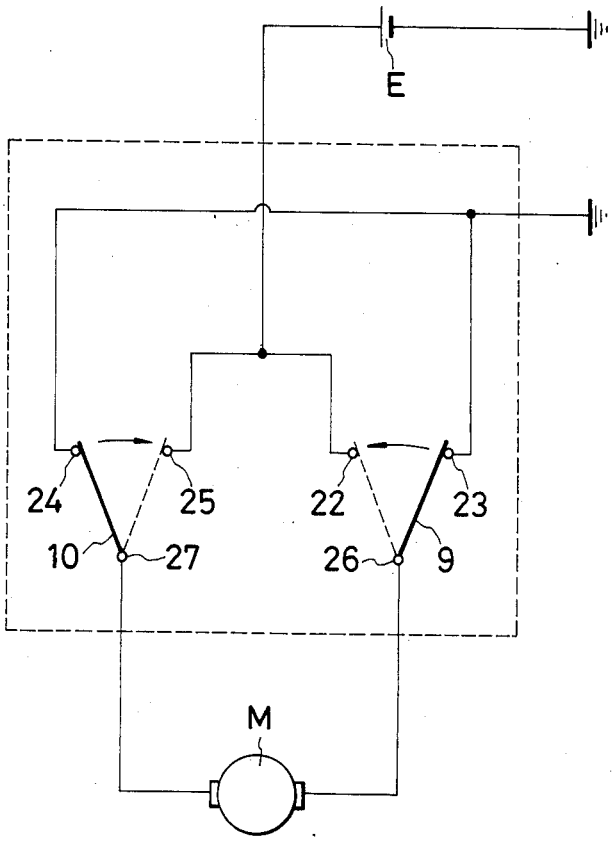
FIG. 17 is a circuit diagram of an example of a motor driving circuit connected with the switch device.

The switch device thus constructed as described above is connected to a motor driving circuit as described with reference to FIG. 17, and is used as a switch for a power window system. In this case, the first and second drivers 41, 42 are elastically contacted with the valleys of the V-shaped bent portions of the first and second conductor plates 57, 59 in the state that the pressing force to the cover 38 is removed, and the switch actuator 37 is disposed at the neutral position as shown in FIG. 1. The movable contacts 64, 65 are contacted under pressure with the stationary contacts 48*a*, 49*a*, and the movable contacts 63, 66 are separated from the stationary contacts 47*a*, 50*a* at such neutral position, and the motor is not rotated.

When the cover 38 is tilted down from the neutral position in a direction of the arrow X in FIG. 1, the first and second drivers 41, 42 are slid on the oblique surfaces of the left side of FIG. 1 of the first and second conductor plates 57, 59, and only the first conductor plate 57 is swung to the stationary contact 47*a* side with the linear portion 51a of the central terminal 51 as a fulcrum. In this case, the second conductor plate 59 remains at its movable contact 65 contacted under pressure with the stationary contact 49*a*. Thus, it is not swung by the tiling of the cover 38 in the direction of the arrow X, but only the first conductor plate 57 side is switched, and the motor is rotated, for example, in a normal direction.

Similarly, when the cover 38 is tilted from the neutral position in the direction of the arrow Y in FIG. 1, the first and second drivers 41, 42 are slid on the oblique surface of the right side of the first and second conductor plates 57, 59 in FIG. 1, the first conductor plate 57 is not slid this time, only the second conductor plate 59 is swung to the stationary contact 50*a* slide with the linear portion 52*b* of the central terminal 52 as a fulcrum, and the motor is rotated in a reverse direction.

In the embodiment described above, the synthetic resin rings 58, 60 attached to the projections 57*a*, 59*a* of the conductor plates 57, 59 are rotatably slid on the bottom of the guide grooves 61, 62. Thus, the conductor plates 57, 59 can be smoothly swung. The invention as described above can be assembled by an automatic machine such as chucking machine can be performed.

According to the present invention as described above, the conductor plates can be associated in the casing dropping by simple the projections of the conductor plates along the guide grooves of the casing and contacting the lower surface with the edge of the central terminal, thereby simply assembling the switch device.

What is claimed is:

1. In a three-position seesaw-type switch comprising a casing having a bottom wall, a top wall, and a first side and a second side positioned opposite each other in a longitudinal direction, a first stationary contact provided on the bottom wall on the first side, a second stationary contact provided on the bottom wall on the second side, an intermediate stationary contact provided on the bottom wall between the first and second stationary contacts, a rockable conductor plate with a first movable contact on a first side thereof and a second movable contact on a second side thereof which are moved into contact with the first and second stationary contacts when the conductor plate is rocked in a first direction and in an opposite, second direction, respectively, and a rockable driver mounted through the top wall of the casing having a driving end slidable abutting on the conductor plate for rocking it in the first and second directions, the improvement comprising:

said intermediate stationary contact being disposed at a position off-center toward said first side of said casing in the longitudinal direction from a center position between said first and second stationary contacts, and having an upper bearing surface and a cutout portion cut into said upper surface so as to form a fulcrum edge facing toward said center position;

said conductor plate having substantially an M-shape with a center portion provided with a lower bend between said first and second sides of said M-shaped conductor plate, wherein said lower bend is positioned substantially at said center position between said first and second stationary contacts facing toward said bottom wall, and said conductor plate has opposing lateral projections located in alignment with the off-center position of said intermediate stationary contact and extending in opposite lateral directions perpendicular to said longitudinal direction;

said casing having opposing lateral walls provided with guide grooves for receiving said lateral projections respectively therein for holding said conductor plate stably in position in said casing;

wherein when said rockable driver has its driving end abutting said lower bend of said M-shaped conductor plate, said conductor plate is in one stable position with said first side thereof bearing in contact against said fulcrum edge of said off-center intermediate stationary contact, and when said rockable driver is rocked in the first direction, said conductor plate is rocked over said fulcrum edge of said off-center intermediate stationary contact as a fulcrum point to bring said first movable contact into electrical contact with said first stationary contact in another stable position.

2. A switch in accordance with claim 1, further comprising a second set of first and second side and intermediate stationary contacts an a second M-shaped conductor plate rockable in contact therewith, said second set being arranged in tandem and in parallel with the first-mentioned set, and said rockable driver having first and second driving ends in parallel for controlling the rocking movement of respective conductor plates in tandem with each other.

* * * * *

UNITED STATES PATENT AND TRADEMARK OFFICE

CERTIFICATE OF CORRECTION

PATENT NO. : 4,803,317

DATED : February 7, 1989

INVENTOR(S) : Sutoh et al.

It is certified that error appears in the above-identified patent and that said Letters Patent is hereby corrected as shown below:

Col. 6, line 41, delete "abutting".

Signed and Sealed this

Fifteenth Day of August, 1989

*Attest:*

*Attesting Officer*

DONALD J. QUIGG

*Commissioner of Patents and Trademarks*